US006677514B2

(12) United States Patent
Fishman

(10) Patent No.: US 6,677,514 B2
(45) **Date of Patent: *Jan. 13, 2004**

(54) COAXIAL MUSICAL INSTRUMENT TRANSDUCER

(75) Inventor: Lawrence R. Fishman, Winchester, MA (US)

(73) Assignee: Fishman Transducers, Inc., Wilmington, MA (US)

( * ) Notice: Subject to any disclaimer, the term of this patent is extended or adjusted under 35 U.S.C. 154(b) by 67 days.

This patent is subject to a terminal disclaimer.

(21) Appl. No.: 10/025,387

(22) Filed: Dec. 19, 2001

(65) Prior Publication Data

US 2002/0117047 A1 Aug. 29, 2002

Related U.S. Application Data

(63) Continuation-in-part of application No. 09/862,087, filed on May 21, 2001, now Pat. No. 6,429,367, which is a continuation of application No. 09/346,720, filed on Jul. 2, 1999, now Pat. No. 6,239,349.

(51) Int. Cl.[7] ..... G10H 3/14

(52) U.S. Cl. ..... 84/730; 84/723; 84/731; 84/DIG. 24

(58) Field of Search ..... 84/723, 730–731, 84/733, DIG. 24

(56) References Cited

U.S. PATENT DOCUMENTS

| | | | | |
|---|---|---|---|---|
| 4,278,000 A | | 7/1981 | Saito et al. | 84/1.16 |
| 4,356,754 A | | 11/1982 | Fishman | 84/1.16 |
| 4,378,721 A | | 4/1983 | Kaneko et al. | 84/1.14 |
| 4,491,051 A | | 1/1985 | Barcus | 84/1.16 |
| 4,654,546 A | | 3/1987 | Kirjavainen | 307/400 |
| 4,727,634 A | | 3/1988 | Fishman | 29/25.35 |
| 4,774,867 A | | 10/1988 | Fishman | 84/1.16 |
| 4,785,704 A | | 11/1988 | Fishman | 84/1.16 |
| 4,911,057 A | | 3/1990 | Fishman | 84/731 |
| 4,944,209 A | | 7/1990 | Fishman | 84/731 |
| 4,975,616 A | | 12/1990 | Park | 310/339 |
| 5,029,375 A | | 7/1991 | Fishman | 29/25.35 |
| 5,155,285 A | | 10/1992 | Fishman | 84/731 |
| 5,189,771 A | | 3/1993 | Fishman | 29/25.35 |
| 5,319,153 A | | 6/1994 | Fishman | 84/731 |
| 5,463,185 A | | 10/1995 | Fishman | 84/731 |
| 5,670,733 A | | 9/1997 | Fishman | 84/731 |
| 5,817,966 A | | 10/1998 | Fishman | 84/731 |
| 6,078,006 A | * | 6/2000 | Raisanen et al. | 84/733 |
| 6,429,367 B2 | * | 8/2002 | Fishman | 84/730 |

* cited by examiner

*Primary Examiner*—Marlon T. Fletcher
(74) *Attorney, Agent, or Firm*—Weingarten, Schurgin, Gagnebin & Lebovici LLP

(57) ABSTRACT

A transducer for a stringed musical instrument utilizes a coaxial structure. An electromechanical film tape is disposed about an inner, electrically conductive core. An outer conductor is formed about the electromechanical film tape. The electromechanical film tape may be provided as a piezoelectric polymer film or an electret film having a permanent electric charge, and is formed about the inner core by wrapping or braiding. Prior to being disposed about the inner core, the film tape may be polarized through the application of a direct current through the film to substantially align the electrical domains in the film. The transducer is configured for placement underneath the saddle in a bridge of a stringed musical instrument.

41 Claims, 4 Drawing Sheets

COAXIAL MUSICAL INSTRUMENT TRANSDUCER

CROSS REFERENCE TO RELATED APPLICATIONS

This application is a continuation-in-part of prior application Ser. No. 09/862,087, filed May 21, 2001 now U.S. Pat. No. 6,429,367, entitled: COAXIAL MUSICAL INSTRUMENT TRANSDUCER, which is a continuation of Ser. No. 09/346,720, now U.S. Pat. No. 6,239,349, filed Jul. 2, 1999 and issued May 29, 2001.

STATEMENT REGAARDING FEDERALLY SPONSORED RESEARCH OR DEVELOPMENT

N/A

BACKGROUND OF THE INVENTION

The present invention relates in general to a musical instrument transducer. More particularly, it relates to a piezoelectric transducer used with a stringed musical instrument such as a guitar.

The prior art shows a variety of electromechanical transducers employed with musical instruments, particularly guitars. Many of these transducers are not completely effective in faithfully converting mechanical movements or vibrations into electrical output signals which precisely correspond to the character of the input vibrations. This lack of fidelity is primarily due to the nature of the mechanical coupling between the driving vibrating member (i.e. a string) and the piezoelectric material of the transducer. Some of the prior art structures, such as those shown in U.S. Pat. Nos. 4,491,051 and 4,975,616, are also quite complex in construction and become quite expensive to fabricate. Furthermore, a transducer using a piezoelectric material requires a conductive layer, a ground layer, and some form of shielding to prevent electrical interference. These multiple layers not only increase the complexity of the transducer, but interfere with the ability to attach leads to the transducer as it is made smaller to operate in a musical instrument.

Differently shaped transducers have been produced for musical instruments. Generally, transducers for stringed instruments have a flat, elongated shape. The piezoelectric layer for such transducers can also be elongated, or can be individual crystals between electrodes. Alternatively, one prior art transducer was coaxially arranged, with a center electrode, surrounding piezoelectric layer, and outer electrode, as illustrated in U.S. Pat. No. 4,378,721.

Each shape offers unique difficulties in construction and varying degrees of quality in operation and performance. For good performance, the piezoelectric layer needs to respond to small string movements at a variety of frequencies. With a thicker layer of piezoelectric material, the material needs to be more flexible; if made too thick, the piezoelectric layer may be too brittle for the intended use, and may not provide satisfactory response characteristics across of range of input stimuli including the smallest string movements. To achieve sufficient resilience in a coaxial arrangement, U.S. Pat. No. 4,378,721 discloses a material formed from a rubber material mixed with a powdered piezoelectric ceramic and a vulcanizing or cross-linking agent. Piezoelectric ceramic is typically brittle and inflexible. This reference relies upon a rubber matrix to bind together the powdered ceramic material. The use of a rubber material results in a significantly thicker piezoelectric material layer, which is inconsistently responsive across a variety of input frequencies; the rubber matrix tends to damp input stimuli, resulting in degraded response. A thicker piezoelectric layer, even if comprised of rubber, becomes more difficult to physically accommodate, to bend or to otherwise manipulate. Over time, it has been found that the composite piezoelectric layer such as described in this reference tends to deform in response to compression such as is typical in a stringed instrument application.

A further disadvantage of the coaxial transducer as described in U.S. Pat. No. 4,378,721 relates to its formation through a casting or molding process, such that the length of the resulting transducer is dependent on the size of the molds available. Other manufacturing processes are not suitable for the composite piezoelectric material due to a low degree of cohesiveness.

Additionally, the polarization of the piezoelectric material of this reference must be performed after completion of the casting procedure. Two opposing, plate-like electrodes, on either side of the transducer, are used to initialize the magnetic domains of the piezoelectric material, thereby complicating and extending the manufacturing process of such a transducer. Therefore, a need exists for an accurate, responsive transducer with a thin, relatively stiff piezoelectric layer which can be economically formed into a coaxial arrangement.

BRIEF SUMMARY OF THE INVENTION

The deficiencies of the prior art are substantially overcome by the transducer according to the present invention, which includes a coaxial structure having a central conductor, a piezoelectric polymer layer, and an outer conductor. The central conductor may be formed of a wire bundle or a solid wire. A piezoelectric cylinder of either a piezoelectric copolymer or a monopolymer is formed about the central conductor. The piezoelectric material may be substantially thinner than that of the prior art, thus providing significantly improved response characteristics for the output signal, while providing a desired degree of flexibility and resistance to deformation over time.

The outer conductor can be formed as a braided sheath or simply as a conductive paint on the outside of the piezoelectric material. Other embodiments include the use of conductive foil, conductive shrink tubing, or any other flexible, conductive material which has a minimal impact on the flexibility of the overall transducer and on the response characteristics of the piezoelectric material. An additional mechanically shielding layer may also be provided, though this layer must not significantly interfere with the responsiveness of the transducer. Leads are attached to the central and outer conductors in order to complete the transducer. The coaxial transducer may be provided with a length sufficient to fit within the saddle of a guitar, underneath the strings. Other embodiments may be configured for use with other stringed musical instruments.

An alternative embodiment of the presently disclosed transducer employs a piezoelectric polymer material provided in the form of a film tape. The tape may be helically wrapped or woven about a central conductive core. An outer conductive layer, provided by a conductive foil, paint or tubing layer, is disposed about the piezoelectric film tape. Further still, an electromechanical film such as an electret film containing an electric charge may be employed in the place of the piezoelectric layer.

BRIEF DESCRIPTION OF THE SEVERAL VIEWS OF THE DRAWING

This invention is pointed out with particularity in the appended claims. The above and further advantages may be more fully understood by referring to the following description and accompanying drawings, of which:

DETAILED DESCRIPTION OF THE INVENTION

Figure 1:
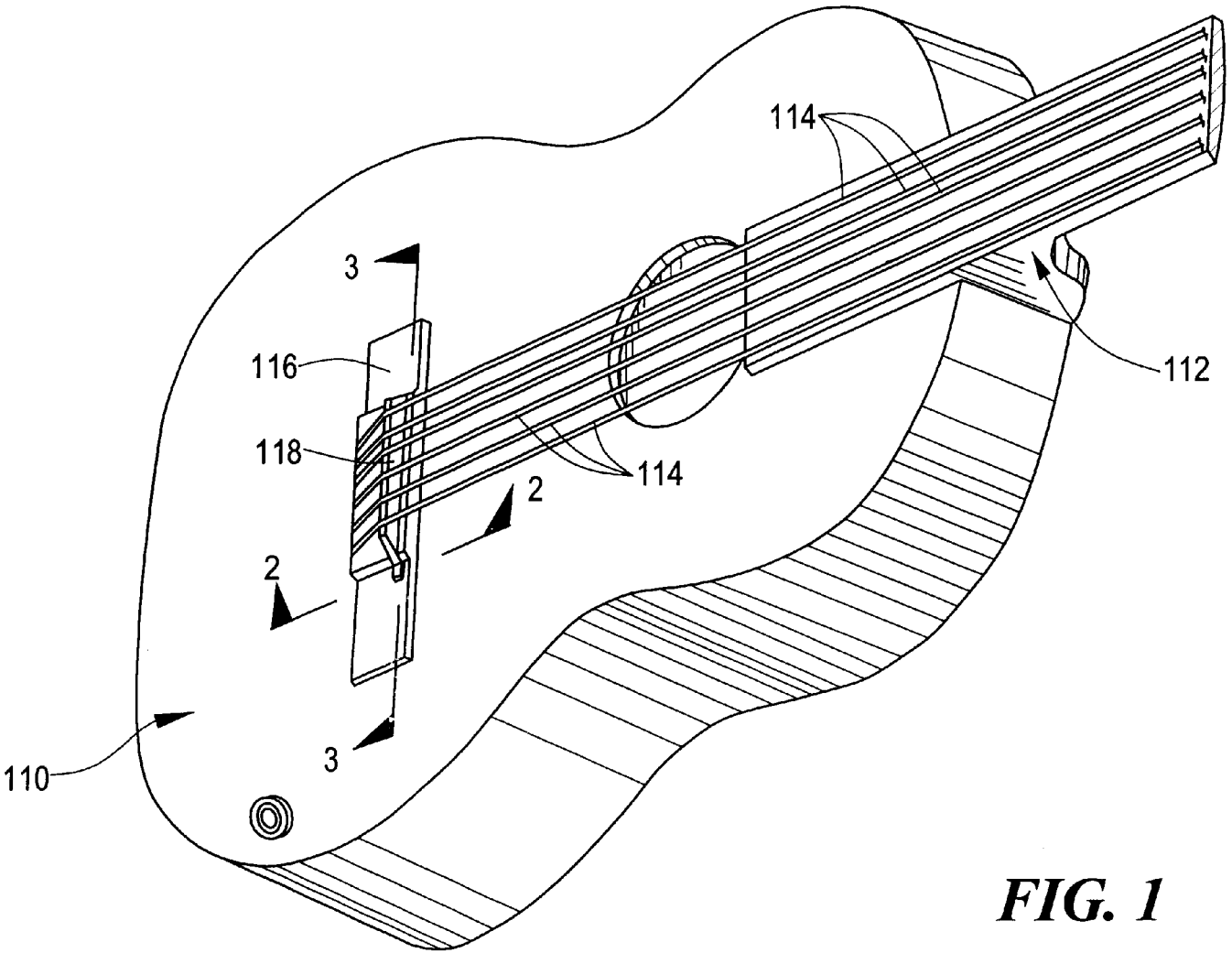
FIG. 1 is a perspective view of a stringed musical instrument, in particular guitar, that has incorporated therein the transducer of the present invention.
Figure 2:
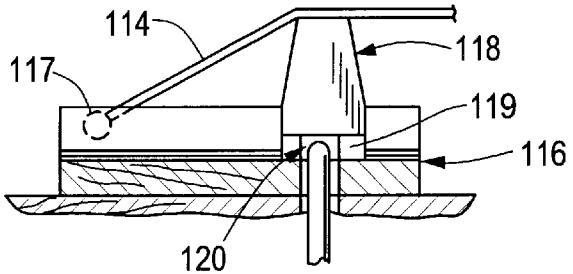
FIG. 2 is a cross-sectional view taken along by 2—2 of FIG. 1.
Figure 3:
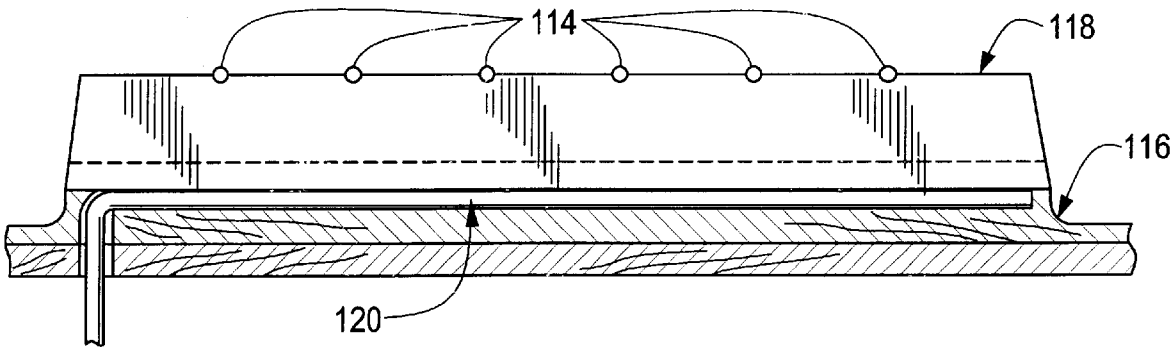
FIG. 3 is a cross-sectional view taken along line 3—3 of FIG. 1.

FIG. 1 illustrates a guitar that is comprised of a guitar body 110 having a neck 112 and supporting a plurality of strings 114. In the embodiment disclosed herein, as illustrated in FIG. 3, there are six strings 114. The strings 114 are supported at the neck end of the instrument (not shown). At the body end of the strings, the support is provided by a bridge 116. The bridge 116 includes a mechanism, such as illustrated in FIG. 2, for securing the end 117 of each of the strings 114. The bridge 116 is slotted, such as illustrated in FIG. 2, in order to receive a saddle at 118. The strings 114 are received in notches in the saddle 118 at the top surface.

FIGS. 2 and 3 illustrate cross-sectional views of the bridge and saddle with the positioning of the transducer of the present invention. The transducer 120 is positioned within the bridge underneath the saddle. As illustrated in FIG. 3, the transducer extends below the entire saddle underneath each of the strings of the instrument. In one embodiment, a portion of the transducer, when fully installed under the saddle, is bent towards and into the interior of the instrument, where conductive leads are attached for communicating the output signal to appropriate signal conditioning and/or amplifying circuitry (not shown) . In this embodiment, installation of the transducer is achieved by feeding a free end of the transducer, opposite the conductive leads, into an opening in the interior of the guitar, beneath the bridge, until the transducer extends under the length of the saddle.

Figure 4:
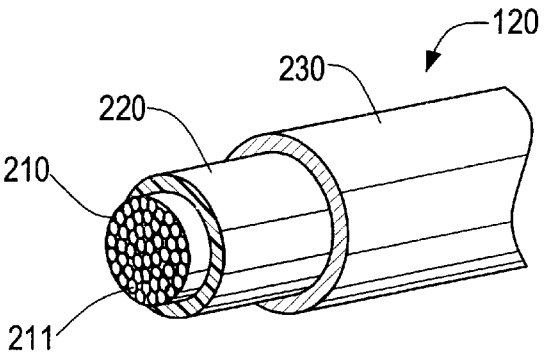
FIG. 4 is a cut-away view of the structure of the transducer according to the present invention.

The structure of the transducer is illustrated in FIG. 4. The transducer of the present invention is formed of an inner conductor 210, an electrically active transducer layer 220, and outer conductive layer 230. Thinner conductor in the illustrated embodiment is formed of conductive material having cylindrical or substantially cylindrical shape. It may be a single wire (not shown) or a twisted bundle of a plurality of individual wires 211. Such a bundle may further include non-conductive elements (not shown) useful for increasing the volume or rigidity of the inner conductive core 210; while it is preferable that the transducer of the present invention be sufficiently flexible that it can easily conform to irregular surfaces under the saddle and can be bent for facilitating installation within a bridge, it may also be useful for the transducer to exhibit a degree of mechanical rigidity as well. According to one embodiment, the inner conductor 210 has a diameter of approximately 0.075 to 0.080 inches.

A layer of an electrically active material such as a piezoelectric polymer material 220 is formed about the inner conductor 210. In one embodiment, the piezoelectric material is formed to have a thickness less than the diameter of the central conductor. In particular, a further embodiment provides the piezoelectric material having a thickness less than half the diameter of the inner conductor. According to a specific variant of this embodiment, the piezoelectric material has a thickness between approximately 0.010 and 0.015 inches. However, in other embodiments, central conductors are employed which are of such dimensions that the piezoelectric layer is as large as or larger than that of the central conductor.

The piezoelectric material is more accurately termed a piezoelectric polymer. The material is an amorphous structure containing many thousand individual crystals, which is constructed by combining different polymeric elements and subjecting them to high temperatures. This forms a fused material containing thousands of crystals. The piezoelectric polymer used in this invention may be a polyvinylidene fluoride (PVDF) copolymer. Alternatively, it may be a PVDF homopolymer. PVDF homopolymers are described in U.S. Pat. No. 4,975,616. PVDF copolymers can include, but are not limited to, vinylidene/tetrafluorethylene and vinylidene/trifluoroethylene polymers. The use of a thin layer of a piezoelectric polymer with a stiffer conductor provides the desired resilience for acceptable outputs from the transducer in a musical instrument and a desired, even responsiveness to a broad range of input frequencies without mechanical loss due to damping. The piezoelectric polymer is sufficiently resilient to offer the desired flexibility without the need for a rubberized matrix, and is resistant to compressive forces over time, such that the original transducer shape is maintained. Polymer materials as used in the presently disclosed transducers also tend to resist becoming brittle over time.

Around the piezoelectric polymer material, an outer conductive layer 230 is formed. The outer conductor 230 may be a braided sheath of wires. Alternatively, the outer conductor may simply be a conductive paint applied to the outer surface of the piezoelectric material. Further embodiments include the use of other flexible, conductive materials, including conductive foil, conductive shrink tubing, or other similar materials. The outer conductor 230 also forms a shield about the transducer. Conductive leads (not shown) are attached to the inner conductor 210 and the outer conductor 230 for providing signals from the transducer. The manner of attaching these leads can be according to state of the art practices with respect to coaxial cables outside the field of transducers. The conductive leads are preferably shielded to avoid the introduction of noise.

Figure 5:
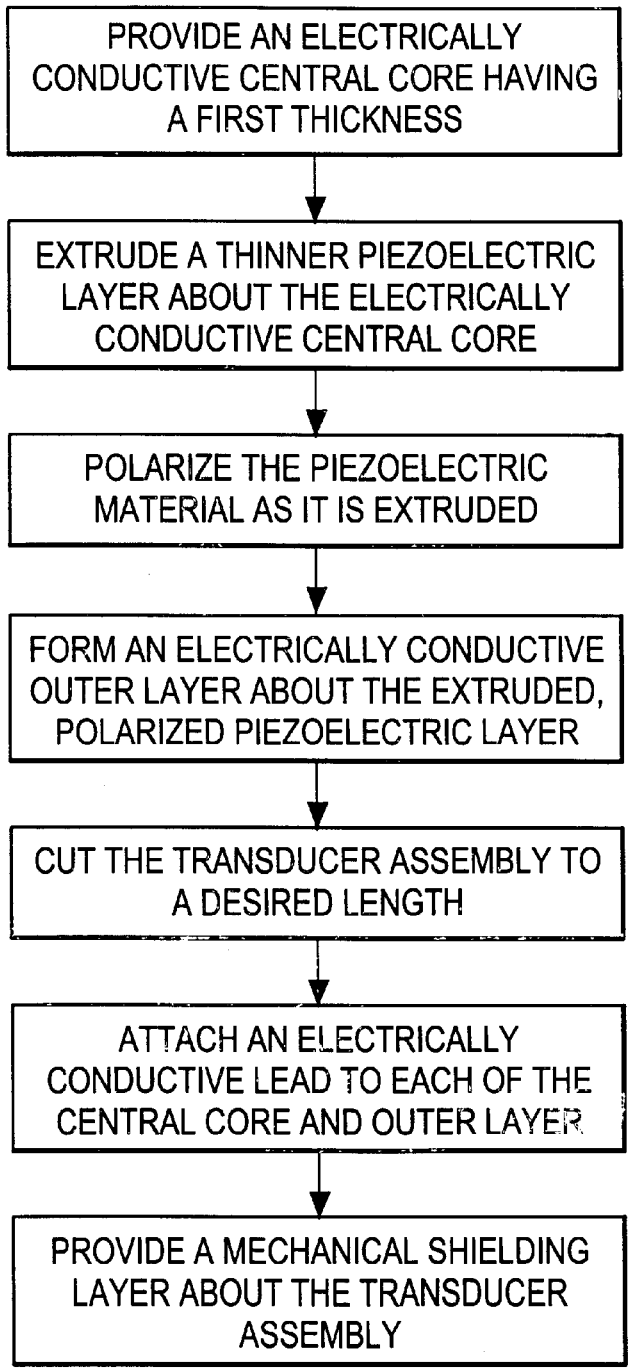
FIG. 5 illustrates a procedure for fabricating a transducer according to the present disclosure.

With reference to FIG. 5, a transducer according to one embodiment of the present disclosure is fabricated according to the following procedure. An electrically conductive central core is provided. Extrusion tools as known to one skilled in the art are employed in forming the piezoelectric polymer material layer about the central core. As part of the same process, the outer conductive layer is formed about the piezoelectric layer. The exact process for application of the outer layer depends upon the material chosen: conductive paint may be sprayed; conductive foil may be wrapped; conductive mesh may be woven.

As part of the extrusion process for this transducer, electrodes may be provided to polarize the piezoelectric polymer material as it is extruded. For instance, exposure to a DC field results in substantial alignment of the magnetic domains within the piezoelectric material. Once so aligned, the piezoelectric material is capable of generating a detectable potential when subject to the stresses to be monitored, in this case, the vibration of strings on a guitar or other musical instrument. Thus, a transducer according to the present disclosure may be fabricated to any length desired and simultaneously polarized, eliminating waste and simplifying the manufacturing process. The exact order of the steps of FIG. 5 may be rearranged in order to accommodate preferred manufacturing practices.

Figure 6:
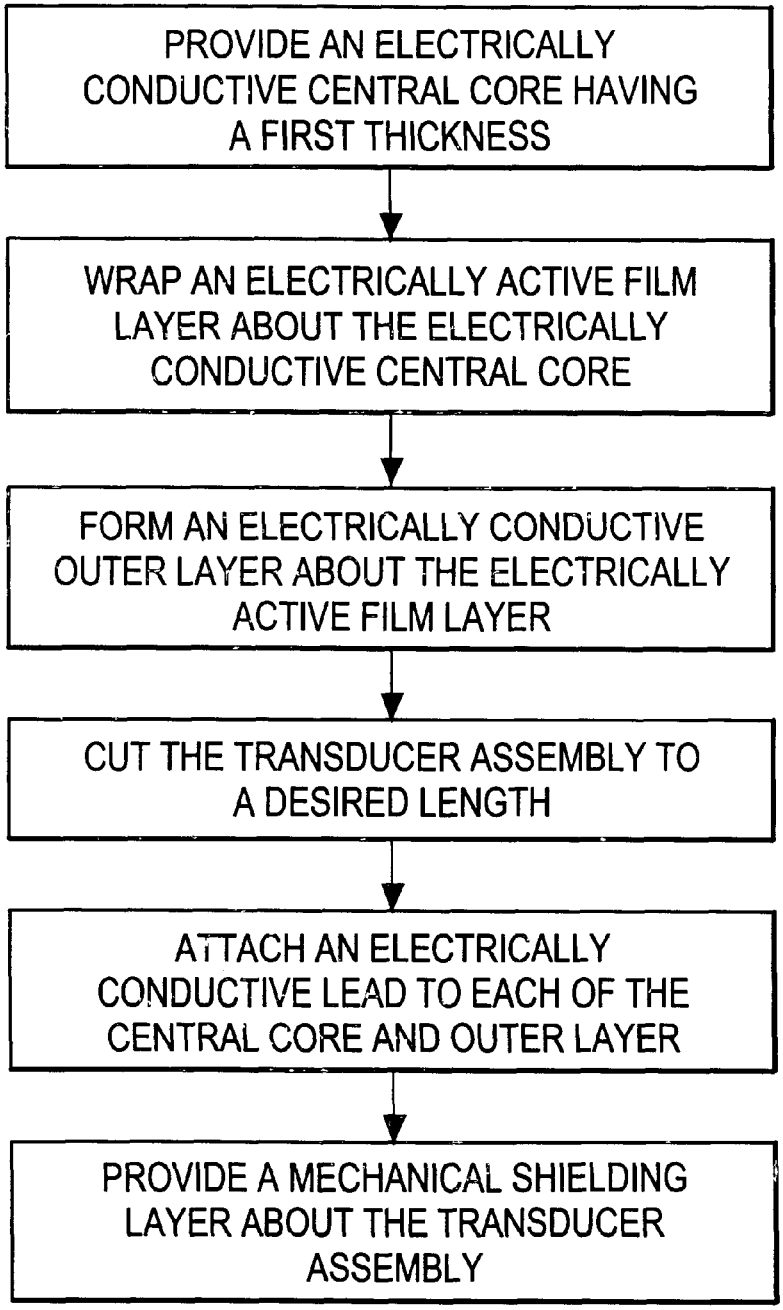
FIG. 6 illustrates a procedure for fabricating another embodiment of a transducer according to the present disclosure.

In an alternative embodiment of the presently disclosed transducer, the piezoelectric polymer material is provided in the form of a film tape. With reference to FIG. 6, a fabrication process for a transducer employing piezoelectric film tape is illustrated. Once again, an electrically conductive central core 210 is provided. The central core can be plural, substantially parallel wires, a solid conductor, or some other arrangement of electrically conductive elements. The piezoelectric polymer layer 220 of FIG. 4 is provided in this embodiment by wrapping the piezoelectric film tape around the central core 210. A helical wrap is employed in a first variant of this embodiment, the pitch of which is chosen depending upon the degree of overlap desired in the wrapped film. While requiring more complex tooling to realize, woven piezoelectric film results in more complete and consistent coverage. In yet further embodiments, it is desirable to provide both helically wound and woven piezoelectric films, or alternating sections of helically wound and woven piezoelectric films. The tooling required for the application of the piezoelectric polymer film tape about the central core is adapted from standard tooling from the cable or electrical conductor industry in which it is common practice to helically wrap or weave plural layers of insulation about one or more conductors.

As with the transducer embodiment employing an extruded piezoelectric polymer layer, the outer conductor layer 230 can be provided in one or more forms, including conductive foil, paint or tubing, braided wire, etc. After being cut to a desired length, conductive leads (not shown) are attached to the transducer assembly of this embodiment.

A further variant of the transducer embodiment employing piezoelectric film tape includes the use of polarized tape. As the piezoelectric polymer is being formed into a film tape, such as through extrusion or other methods known in the art, direct current is applied to the material in order to substantially align the electrical domains within the piezoelectric polymer material. In specific versions of this embodiment, the piezoelectric polymer film tape is provided from polyvinylidene fluoride (PVDF) copolymer or homopolymer.

Yet another transducer embodiment according to the present disclosure includes the use of an electromechanical film other than a piezoelectric film as the electrically active transducer layer 220. For instance, a dielectric layer in between opposing electrical conductor layers in both Kirajavanien (U.S. Pat. No. 4,654,546) and Räisänen et al. (U.S. Pat. No. 6,078,006) is provided as an electret film 220 containing a permanent electrical charge. An electret is a dielectric that produces a permanent external electric field which results from permanent ordering of molecular dipoles or from stable uncompensated surface or space charge. Electret films may be produced according to a variety of known approaches, then wrapped or woven about a central conductor in the manner disclosed above for piezoelectric polymers.

Regardless of the specific composition of the active transducer layer, the fabrication process is substantially the same. In order to capture the pumped charge or electrical activity of the active transducer material which results from varying mechanical stress and strain, electrically conductive materials must be placed on opposite sides of the active transducer material. It is also necessary to provide an electrically conductive shield surrounding the sensor material. The shield layer prevents electromagnetic interference from entering the signal path. Fortunately, the shield layer may also function as a signal conducting layer for monitoring the electrical activity of the adjacent transducer layer. In a preferred but non-exclusive embodiment, the outer layer is provided as a woven, braided wire jacket. Such a jacket provides adequate electrical and mechanical shielding, as well as facilitating the attachment of an electrically conductive lead thereto.

A further refinement of this processing technique involves the provision of a first, outer conductive layer in contact with the transducer layer. The first, outer conductive layer is provided as conductive paint, vacuum deposited metal, or other low-profile, flexible layer. Then, a second, outer conductive layer outside the first such layer is provided such as through a braided wire layer which affords electrical and mechanical shielding. While optional, the provision of such a separate mechanical shielding layer is illustrated in FIG. 6, as it is in FIG. 5.

In alternative embodiments of the present disclosure, the cross-section of the resulting transducer is not perfectly round, but may be symmetrically or asymmetrically ovoid. Further, one or more sides of the transducer cross-section may be flat. For instance, the transducer assembly may have a rectangular cross-section. The choice of cross-sectional configuration may depend upon the environment into which the transducer is to be installed and any apertures through which the transducer must pass in order to reach its operating position. It is preferred in one embodiment that the central conductor have a diameter or thickness which is greater than the maximum thickness of the surrounding piezoelectric layer, regardless of cross-sectional configuration. Appropriate extrusion tooling is employed for these various configurations. Flexibility in determining transducer length through an extrusion process is maintained.

Further layers may be incorporated into the transducer as presently disclosed. For instance, it may be desirable to incorporate a mechanical shielding layer over the outer conductive layer. However, care must be exercised in selecting a shield material which protects the outer conductor without compromising the responsiveness of the piezoelectric material.

Having described at least one embodiment, it should now be apparent to those skilled in the art that numerous other modifications and changes can apply to this invention. Specifically, variations in the dimensions listed herein are contemplated. Additionally, while a transducer according to the present invention has been described for use with an acoustic guitar, the transducer may be utilized with other stringed instruments such as, without limitation, violas, pianos, or electric guitars. Such modifications and changes are contemplated as falling within the scope of the invention, which is limited solely by the pending claims.

What is claimed is:

1. A musical instrument transducer comprising:

an inner conductor comprising electrically conductive material;

an electrically active transducer layer about the inner conductor, wherein the electrically active transducer layer is provided in the form of a film tape; and an outer conductor, comprising electrically conductive material, disposed about the electrically active transducer layer.

2. The musical instrument transducer of claim 1, further comprising electrically conductive leads connected to the inner conductor and the outer conductor.

3. The musical instrument transducer of claim 1, wherein the thickness of the electrically active transducer layer is less than half the thickness of the inner conductor.

4. The musical instrument transducer of claim 1, wherein the inner conductor has a thickness of between 0.075 and 0.08 inches.

5. The musical instrument transducer of claim 1, wherein the electrically active transducer layer has a thickness of between 0.010 and 0.015 inches.

6. The musical instrument transducer of claim 1, wherein the electrically active transducer layer is formed by wrapping the film tape about the inner conductor.

7. The musical instrument transducer of claim 6, wherein the electrically active transducer layer is formed by helically wrapping the film tape about the inner conductor.

8. The musical instrument transducer of claim 1, wherein the electrically active transducer layer is formed by weaving the film tape about the inner conductor.

9. The musical instrument transducer of claim 1, wherein the inner conductor is a twisted bundle of wires.

10. The musical instrument transducer of claim 1, wherein the inner conductor is a solid, electrically conductive material.

11. The musical instrument transducer of claim 1, wherein the outer conductor is an electrically conductive ink formed on an outer surface of the electrically active transducer layer.

12. The musical instrument transducer of claim 1, wherein the outer conductor is an electrically conductive foil disposed on an outer surface of the electrically active transducer layer.

13. The musical instrument transducer of claim 1, wherein the outer conductor is an electrically conductive shrink tube disposed on an outer surface of the electrically active transducer layer.

14. The musical instrument transducer of claim 1, wherein the outer conductor is a braid of electrically conductive filaments disposed on an outer surface of the electrically active transducer layer.

15. The musical instrument transducer of claim 1, wherein the transducer has a substantially circular cross-section.

16. The musical instrument transducer of claim 1, wherein the transducer has a substantially rectangular cross-section.

17. The musical instrument transducer of claim 1, wherein the inner conductor further comprises a non-conductive filler material.

18. The musical instrument transducer of claim 1, further comprising a mechanically shielding layer disposed about the outer conductor.

19. The musical instrument transducer of claim 1, wherein the electrically active transducer film tape is polarized.

20. The musical instrument transducer of claim 1, wherein the electrically active transducer film tape is a piezoelectric polymer film tape selected from the group consisting of polyvinylidene fluoride copolymer film tape and polyvinylidene fluoride homopolymer film tape.

21. The musical instrument transducer of claim 1, wherein the electrically active transducer layer comprises a piezoelectric polymer layer.

22. A musical instrument transducer comprising:

an inner conductor comprising electrically conductive material;

an electret film layer about the inner conductor, wherein the electret film layer is provided in the form of an electret film tape having a permanent electric charge; and an outer conductor, comprising electrically conductive material, disposed about the electret film layer.

23. The musical instrument transducer of claim 22, wherein the thickness of the electret film layer is less than half the thickness of the inner conductor.

24. The musical instrument transducer of claim 22, wherein the electret film layer is formed by wrapping or weaving the film tape about the inner conductor.

25. The musical instrument transducer of claim 22, wherein the outer conductor is selected from the group consisting of an electrically conductive ink, an electrically conductive foil, an electrically conductive shrink tube, and a braid of electrically conductive filaments.

26. The musical instrument transducer of claim 22, further comprising a mechanically shielding layer disposed about the outer conductor.

27. A method of fabricating a musical instrument transducer, comprising the steps of:

providing an electrically conductive central core;

providing an electrically active transducer layer in the form of a film tape about said electrically conductive central core;

forming an electrically conductive outer layer about said film tape to produce an assembly;

cutting said assembly to a desired length; and disposing electrically conductive leads in communication with said electrically conductive central core and said electrically conductive outer layer.

28. The method of claim 27, wherein the step of providing an electrically conductive central core further comprises providing an electrically conductive central core comprising at least one electrically conductive fiber.

29. The method of claim 28, wherein the step of providing an electrically conductive central core further comprises providing an electrically conductive central core comprising said at least one electrically conductive fiber in conjunction with at least one non-conductive fiber.

30. The method of claim 27, wherein the step of providing an electrically active transducer layer in the form of a film tape further comprises wrapping the film tape about the electrically conductive central core.

31. The method of claim 27, wherein the step of providing an electrically active transducer layer in the form of a film tape further comprises helically wrapping the film tape about the electrically conductive central core.

32. The method of claim 27, wherein said step of providing an electrically active transducer layer in the form of a film tape further comprises weaving the film tape about the electrically conductive central core.

33. The method of claim 27, wherein the step of forming further comprises a step selected from the group of steps consisting of: braiding electrically conductive fibers about said film tape; applying an electrically conductive foil about the film tape; forming electrically conductive shrink tubing about the film tape; and applying an electrically conductive liquid on the film tape and allowing the applied electrically conductive liquid to dry.

34. The method of claim 17, further comprising the step of disposing a mechanically shielding layer about the electrically conductive outer layer.

35. The method of claim 27, wherein the steps of providing an electrically conductive central core, providing an electrically active transducer layer in the form of a film tape, and forming an electrically conductive outer layer collectively result in a musical instrument transducer having a substantially circular cross-section.

36. A method of fabricating a musical instrument transducer, comprising the steps of:

providing an electrically conductive central core;

providing an electret film tape having a permanent electric charge about said electrically conductive central core;

forming an electrically conductive outer layer about said electret film tape to produce an assembly;

cutting said assembly to a desired length; and disposing electrically conductive leads in communication with said electrically conductive central core and said electrically conductive outer layer.

37. The method of claim 36, wherein the step of providing an electrically conductive central core further comprises providing an electrically conductive central core comprising at least one electrically conductive fiber.

38. The method of claim 37, wherein the step of providing an electrically conductive central core further comprises providing an electrically conductive central core comprising said at least one electrically conductive fiber in conjunction with at least one non-conductive fiber.

39. The method of claim 36, wherein the step of providing a electret film tape further comprises wrapping or weaving the electret film tape about the electrically conductive central core.

40. The method of claim 36, wherein the step of forming further comprises a step selected from the group of steps consisting of: braiding electrically conductive fibers about said electret film tape; applying an electrically conductive foil about the electret film tape; forming electrically conductive shrink tubing about the electret film tape; and applying an electrically conductive liquid on the electret film tape and allowing the applied electrically conductive liquid to dry.

41. The method of claim 36, further comprising the step of disposing a mechanically shielding layer about the electrically conductive outer layer.

* * * * *

UNITED STATES PATENT AND TRADEMARK OFFICE

CERTIFICATE OF CORRECTION

PATENT NO. : 6,677,514 B2
DATED : January 13, 2004
INVENTOR(S) : Fishman, Lawrence R.

It is certified that error appears in the above-identified patent and that said Letters Patent is hereby corrected as shown below:

Title page,
Item [*] Notice, should read:
-- Subject to any disclaimer, the term of this patent is extended or adjusted under 35 U.S.C. 154 (b) by 0 days. --.

Signed and Sealed this

Sixth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,677,514 B2
DATED : January 13, 2004
INVENTOR(S) : Lawrence R. Fishman It is certified that error appears in the above-identified patent and that said Letters Patent is hereby corrected as shown below:

Column 1,
Line 14, "REGAARDING" should read -- REGARDING --;

Column 3,
Line 51, "Thinner" should read -- The inner --; and

Column 8,
Line 58, "17" should read -- 27 --.

Signed and Sealed this

Sixth Day of June, 2006

JON W. DUDAS
*Director of the United States Patent and Trademark Office*